US007959522B2

(12) United States Patent
North, III et al.

(10) Patent No.: US 7,959,522 B2
(45) Date of Patent: Jun. 14, 2011

(54) GOLF DRIVER HEAD WITH EXCHANGEABLE REAR SECTIONS

(75) Inventors: Richard Ray North, III, Pittsburgh, PA (US); Ben S. Lavallee, McDonald, PA (US)

(73) Assignee: Dick's Sporting Goods, Inc., Pittsburgh, PA (US)

( * ) Notice: Subject to any disclaimer, the term of this patent is extended or adjusted under 35 U.S.C. 154(b) by 0 days.

(21) Appl. No.: 12/190,249

(22) Filed: Aug. 12, 2008

(65) Prior Publication Data

US 2010/0041495 A1 Feb. 18, 2010

(51) Int. Cl.
*A63B 53/00* (2006.01)
*A63B 53/06* (2006.01)

(52) U.S. Cl. ..... 473/288; 473/324; 473/345

(58) Field of Classification Search ..... 473/288, 473/324–350

See application file for complete search history.

(56) References Cited

U.S. PATENT DOCUMENTS

| | | | | |
|---|---|---|---|---|
| 5,421,577 | A | 6/1995 | Kobayashi | |
| 5,439,223 | A | 8/1995 | Kobayashi | |
| 5,518,243 | A | 5/1996 | Redman | |
| 5,776,010 | A | 7/1998 | Helmstetter et al. | |
| 5,803,830 | A | 9/1998 | Austin et al. | |
| 6,409,612 | B1 | 6/2002 | Evans et al. | |
| 6,440,009 | B1 | 8/2002 | Guibaud et al. | |
| 6,450,897 | B2 | 9/2002 | Stites et al. | |
| 6,458,044 | B1 | 10/2002 | Vincent et al. | |
| 6,558,271 | B1 | 5/2003 | Beach et al. | |
| 6,623,378 | B2 * | 9/2003 | Beach et al. | 473/345 |
| 6,773,360 | B2 | 8/2004 | Willett et al. | |
| 7,108,611 | B2 * | 9/2006 | MacIlraith | 473/288 |
| 7,121,955 | B2 * | 10/2006 | Stevens et al. | 473/334 |
| 7,413,517 | B2 * | 8/2008 | Butler et al. | 473/288 |
| 7,481,720 | B2 * | 1/2009 | Tavares | 473/345 |
| 7,566,276 | B2 * | 7/2009 | Billings | 473/251 |
| 7,628,713 | B2 * | 12/2009 | Tavares | 473/345 |
| 7,749,096 | B2 * | 7/2010 | Gibbs et al. | 473/329 |
| 2005/0272523 | A1 | 12/2005 | Atkins | |
| 2006/0089206 | A1 | 4/2006 | Lo | |
| 2006/0223649 | A1 | 10/2006 | Rife | |
| 2007/0105649 | A1 | 5/2007 | Beach et al. | |
| 2007/0232407 | A1 * | 10/2007 | Tavares | 473/282 |
| 2007/0243950 | A1 * | 10/2007 | Billings | 473/340 |
| 2008/0102978 | A1 * | 5/2008 | Burnett et al. | 473/324 |

FOREIGN PATENT DOCUMENTS

JP 2004065810 A * 3/2004

* cited by examiner

*Primary Examiner* — Alvin A Hunter

(74) *Attorney, Agent, or Firm* — Buchanan Ingersoll & Rooney PC

(57) ABSTRACT

A golf driver kit includes a front portion and a plurality of rear portions exchangeably connectable to the front portion and being of different respective shapes for imparting different flight characteristics to a struck golf ball. The front portion includes a front face plate and a hosel for receiving a shaft, plus a rearwardly projecting base on which the rear portion is seated. The rear portion is removably attached to the front portion by screws.

12 Claims, 4 Drawing Sheets

GOLF DRIVER HEAD WITH EXCHANGEABLE REAR SECTIONS

BACKGROUND

The invention relates to golf clubs, and especially to golf driver heads.

Traditionally, the configuration of golf drivers has varied between a generally square shape, a pulled-back shape (or C-shape), and a generally triangular shape. The underlying reason for different shapes is that there are certain times when using each shape would be beneficial to the player, depending on the venue and weather conditions.

For example, square drivers are universally believed to achieve a tighter shot dispersion due to the enhanced moment of inertia (MOI) achieved by the square shape. A drawback to the square shape is that the distance is generally believed to come up short in comparison to the triangular or pulled-back driver. The square shape is ideal for tight layouts where landing areas are minimal and accuracy is paramount.

Triangular and pulled-back driver versions generally do not achieve as high of an MOI as square drivers, however the center of gravity (CG) is placed lower and more back towards the skirt in these versions which results in a high launch, low spin combination for greater distance carry and roll. This type of driver is ideal for less penal course designs where an increased shot dispersion is not as likely to be penalized and the landing areas are greater.

Another variable which can influence driver performance is weight. Adjustable weight in drivers is used to influence shot trajectory and shape by manipulating the CG in the club head. Adjusting the CG in the driver head with a bias towards the heel or toe is used to achieve a fade or draw bias. For example, a player who slices the ball will put the weight towards the heel to help the toe come over. A player generally adjusts the weight once and never changes again. Generally speaking, adjusting the CG in a driver head negatively impacts the MOI so weight adjustment is generally not used in square drivers.

Purchasing multiple drivers with those different shapes involves an added expense, so it would be desirable to provide a less costly way of enabling a golfer to take advantage of the different performances achieved by those shapes.

It would thus be desirable to provide a more economical way for a golfer to take advantage of the different performances achieved by varied driver shapes.

SUMMARY

The present invention relates to a golf driver head kit comprising a front portion, a plurality of rear portions interchangeably connectable to the front portion and being of different respective shapes, and releasable fasteners for selectively securing a selected rear portion to the front portion. The front portion includes a front face plate and a hosel for receiving a shaft.

Preferably, the front portion includes a rearwardly extending base having an upstanding tab at its rear end, and the rear portion includes a back wall adjacent the tab and secured thereto by a screw.

Another aspect of the invention pertains to a golf driver head comprising a front portion including a generally rectangular frame section defining a hollow interior, a front plate disposed on the frame section, a generally rectangular ridge extending rearwardly from the frame section, a hosel extending upwardly from the frame, a base extending rearwardly from a lower portion of the frame, and a tab extending upwardly from a rear end of the base. A rear portion includes a front end mating with the ridge, a lower wall having a notch formed therein for receiving the base, and a back wall adjacent the tab. The front and rear portions are releasably interconnected by a first pair of screws extending through holes in the rear portion and into threaded holes in the hollow of the front portion, and by a rear screw extending through the back wall and into a threaded screw formed in the tab.

DETAILED DESCRIPTION OF A PREFERRED EMBODIMENT

Figure 8:
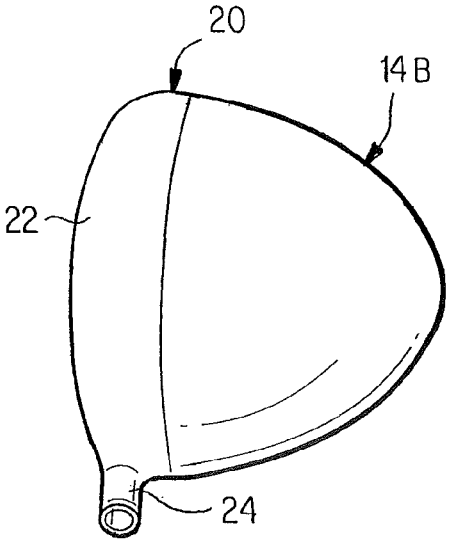
FIG. 8 is a top plan view of an alternative triangular shaped rear portion of the driver head which can be exchanged with the one shown in FIGS. 1-7.
Figure 9:
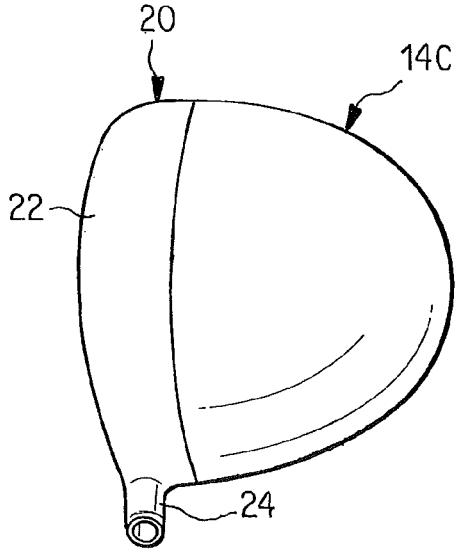
FIG. 9 is a top plan view of an alternative reverse C-shaped rear portion which can be exchanged with the one shown in FIGS. 1-7.

Depicted in FIGS. 1-7 is a golf driver head 10 which comprises a front portion 12 adapted to selectively receive one of a number of differently shaped rear portions, namely a "square" type 14A shown in those figures, or a "triangular" type 14B shown in FIG. 8 or a "pulled-back" type (i.e., a reverse c-shape)14C shown in FIG. 9. The rear portions 14A, 14B, 14C have a common generic configuration for connection to the front portion 12 and differ only in their external shapes, designed to produce different influences on a struck golf ball.

Figure 1:
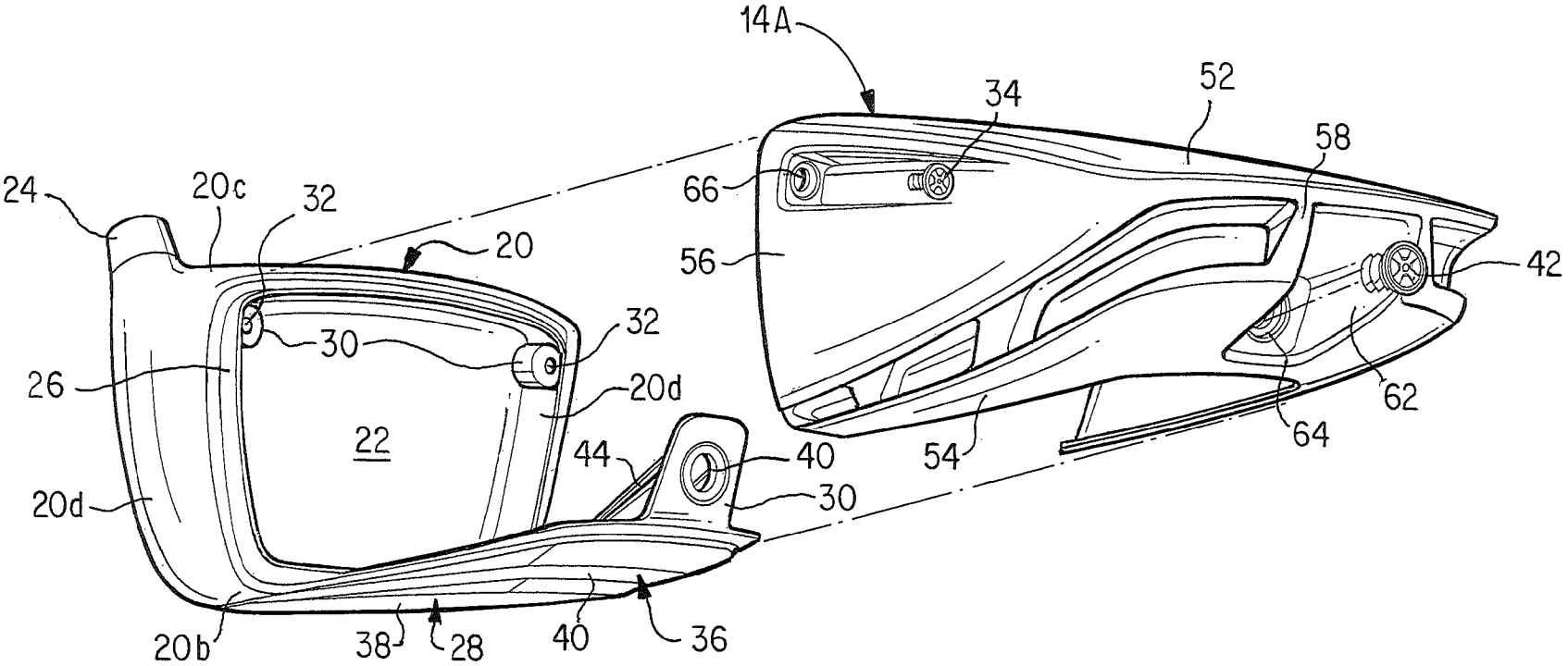
FIG. 1 is an exploded rear lower perspective view of a golf driver head according to the invention.
Figure 2:
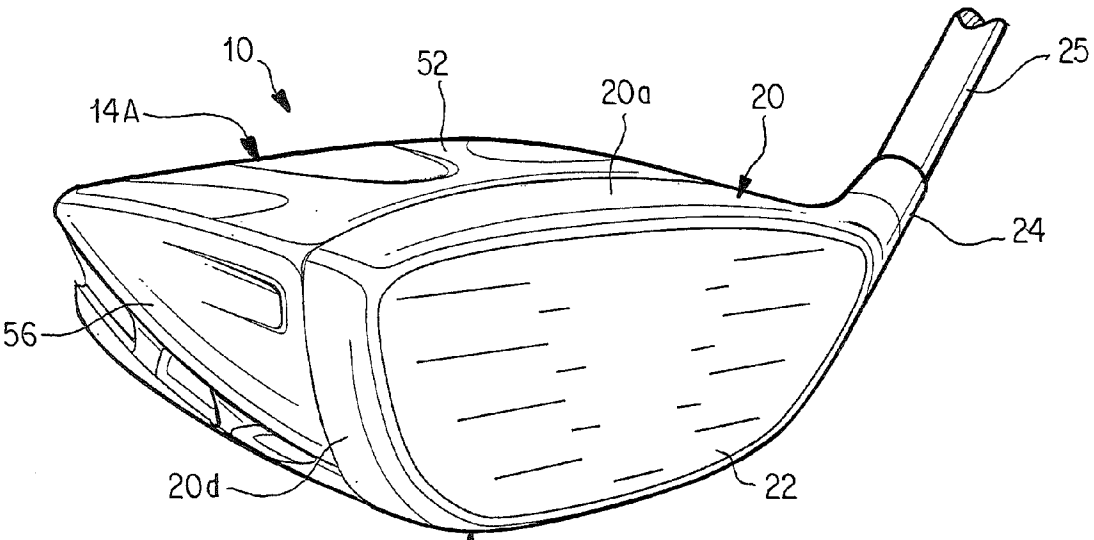
FIG. 2 is a top front perspective view of the assembled golf driver head according to FIG. 1.

The front portion 12 includes a generally rectangular hollow frame section 20, a front face plate 22 for striking a ball, a hosel 24 projecting from the frame section for receiving a shaft 25, a rearwardly-projecting four-sided ridge 26 adapted to mate with a front edge of the rear portion 14A (or 14B, or 14C), and a base 28 for underlying the rear portion. The rear end of the base 28 includes an upstanding tab 30 for making connection with a back side of the rear portion 14A as will be explained. FIG. 2 depicts the head, in front perspective, after the rear portion 14A has been attached to the front portion 12.

The frame section 20 includes a top 20*a*, a bottom 20*b*, a back 20*c* and two sides 20*d*. The ridge 26, which projects from the back 20*c*, borders a rearwardly facing opening defined by the hollow frame section, and is arranged to fit within the front end of the rear portion.

The face plate 22 can be integral with the frame 20, or separately attached thereto in a known fashion, e.g., by welding, whereas the hosel 24, the ridge 26, and the base 28 are preferably formed integrally of one piece with the frame section 20.

Disposed within the hollow of the frame section 20 are two ears 30 having rearwardly facing threaded holes 32 formed therein for receiving respective screws 34 that attach the rear portion to the front portion.

The base 28 extends rearwardly from the bottom 26 of the frame portion and has a stepped underside 36 due to a lowermost section 38 of the base terminating at a region forwardly of the rear end of the base to form a step 40. The base includes side edges 37*a*, 37*b* (see FIG. 5) which generally converge in a rearward direction and join a rear edge 37*c*.

Figure 4:
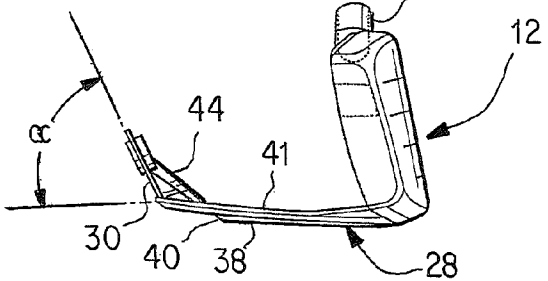
FIG. 4 is a side view of a front portion of the golf driver head.
Figure 3:
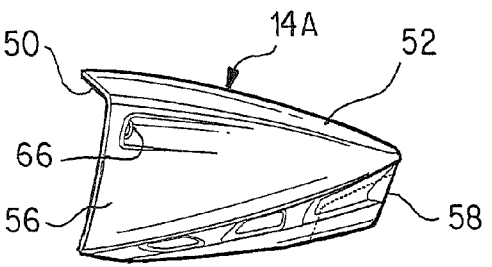
FIG. 3 is a side view of a square-shaped rear portion of the golf driver head.
Figure 5:
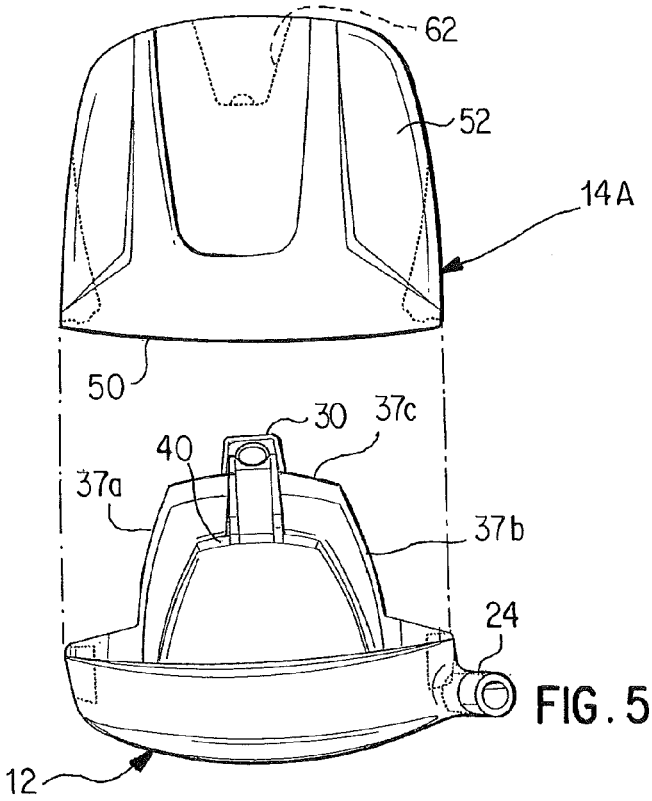
FIG. 5 is an exploded top plan view of the golf driver head.
Figure 6:
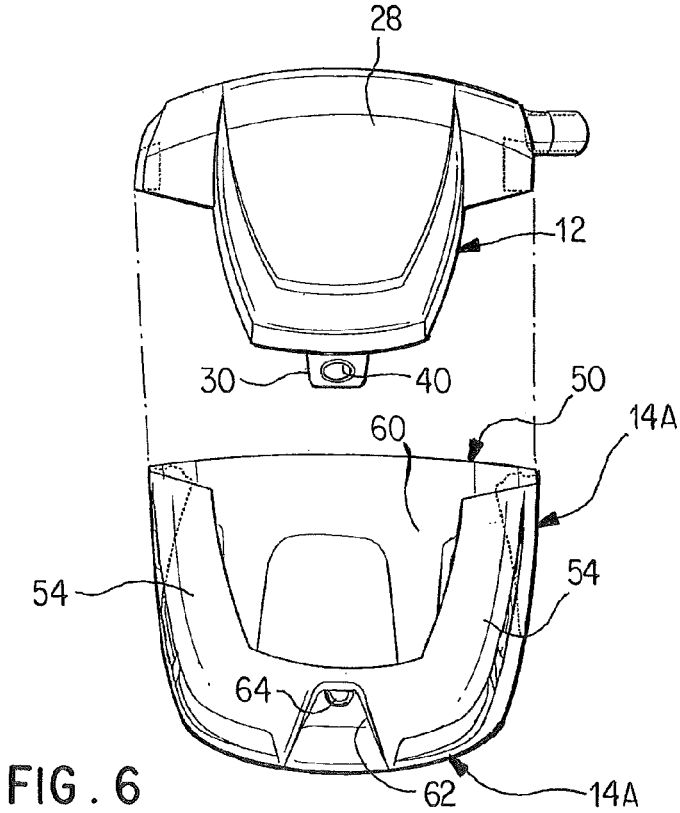
FIG. 6 is an exploded bottom plan view of the golf driver head.
Figure 7:
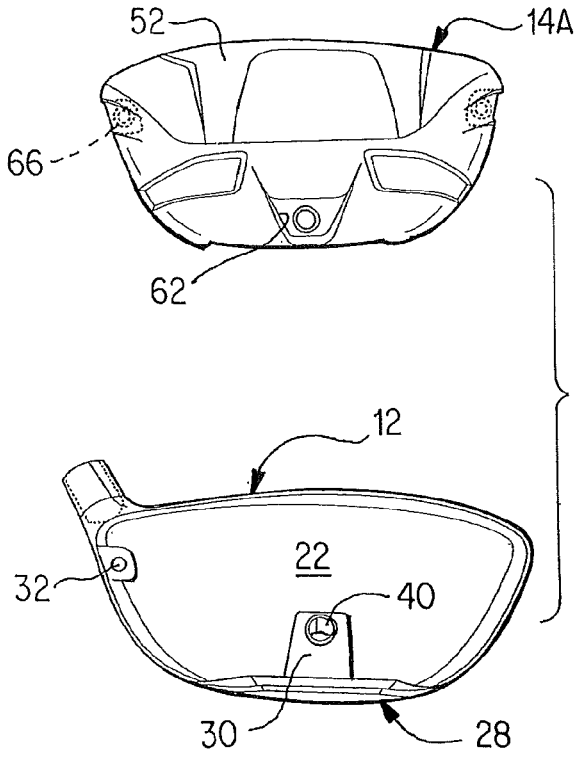
FIG. 7 is an exploded rear view of the golf driver head.

The tab 30 extends upwardly and rearwardly from the rear edge of the base at an acute angle a of about 450 (FIG. 4). A threaded hole 40 is formed through the tab in a generally front-to-rear direction for receiving a screw 42 that connects the rear portion 14A (or 14B or 14C) to the front portion 12. The tab 30 is reinforced by bracing ribs 44 extending upwardly from a top face 41 of the base 28.

The rear portion 14A includes, at its front, a generally rectangular front edge 50 (FIG. 6) which mates with the front portion 12 by fitting around the ridge 26 of the front portion. Also, the rear portion includes a top wall 52, a bottom wall 54, two side walls 56, and a back wall 58. The top wall lies generally flush with the top 20*a* of the front portion, and the side walls 56 lie generally flush with the sides 20*d* of the front portion. The bottom wall 54 has formed therein a three-sided notch 60 (FIG. 6) the edge of which rests on the base 28 of the front portion. The back wall 58 overlies the tab 30 of the base. Also, the back wall includes a non-threaded hole 64 through which the screw 42 extends to enter the threaded hole 40 of the tab in order to secure the back wall to the tab. The hole 56 is formed in a recess or pocket 62 of the back wall 58. The rear portion also includes a pair of non-threaded holes 66 near the front edge which align with the threaded holes 32 of the front portion, to enable the screws 34 to further secure the rear portion to the front portion.

The only difference between the square type rear portion 14A and the other rear portions 14B, 14C is their general shape. Each rear portion 14B, 14C includes the front edge 50, the top, bottom and side walls 52, 54, 56, the notch 60 and the holes 64, 66, enabling the rear portions to be exchanged for one another by removing the screws 34, 42. However, the rear portion 14B is of generally triangular shape, and the rear portion 14C is of generally pulled-back shape (reverse C-shape), so they impart different flight characteristics to a struck ball.

The front portion and at least two of the rear portions can be sold together as a kit, enabling the user to exchange the rear portions as desired.

The front and rear portions can be formed of any suitable material, such as titanium and stainless steel, for example.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A golf driver head kit comprising:

a front portion including a hollow frame section having a front face plate and a hosel projecting upwardly from the frame section; and a plurality of exchangeable rear portions selectively connectible to the front portion, each rear portion including a forwardly facing edge arranged to mate with the frame portion, the rear portions having different respective external shapes for imparting different effects to golf shots; and a releasable fastening structure for selectively securing a selected rear portion to the front portion, wherein a combination of the front portion and each rear portion defines a golf driver head, wherein each selected rear portion is configured to be separated from the front face plate by an empty space, and wherein the plurality of exchangeable rear portions includes at least two of: i) a rear portion of generally rectangular shape; ii) a rear portion of generally triangular shape; and iii) a rear portion of generally reverse C-shape, wherein all shapes are from a top view.

2. The kit according to claim 1 wherein the front portion includes a rearwardly facing opening is encompassed by a rearward projecting ridge received in the front end of the rear portion.

3. The kit according to claim 1 wherein the releasable fastening structure comprises screws.

4. The kit according to claim 3 wherein each rear portion includes holes through which the screws can extend, and the front portion includes rearwardly open threaded holes each receiving a respective screw.

5. The golf driver head kit according to claim 1 wherein the front portion includes a rearwardly extending base having an upstanding tab at its rear end; the rear portion including a back wall; the releasable fastening structure including a screw connecting the back wall to the tab.

6. The golf driver head according to claim 5 wherein the releasable fastening structure comprises screws.

7. The golf driver head according to claim 5 wherein the rear portion includes a notch formed therein for receiving the base.

8. The kit according to claim 1 wherein the plurality of exchangeable rear portions includes all three of i) the rear portion of generally rectangular shape; ii) the rear portion of generally triangular shape; and iii) the rear portion of generally reverse C-shape.

9. A golf driver head kit comprising:

a shaft;

a front portion including a hollow frame section having a front face plate, a rearwardly facing opening, and a hosel projecting upwardly from the frame section and receiving the shaft; and a plurality of exchangeable rear portions selectively connectible to the front portion, each rear portion including a forwardly facing edge arranged to mate with the frame portion, the rear portions having different respective external shapes for imparting different effects to golf shots; and a releasable fastening structure for selectively securing a selected rear portion to the front portion, wherein a combination of the front portion and each rear portion defines a golf driver head;

wherein each selected rear portion is configured to be separated from the front face plate by an empty space, and wherein the plurality of exchangeable rear portions includes at least two of: i) a rear portion of generally rectangular shape; ii) a rear portion of generally triangular shape; and iii) a rear portion of generally reverse C-shape, wherein all shapes are from a top view.

10. The kit according to claim 9 wherein the plurality of exchangeable rear portions includes all three of i) the rear portion of generally rectangular shape; ii) the rear portion of generally triangular shape; and iii) the rear portion of generally reverse C-shape.

11. A golf driver head kit comprising:

a front portion including a hollow frame section having a front face plate and a hosel projecting upwardly from the frame section; and a plurality of exchangeable rear portions selectively connectible to the front portion, each rear portion including a forwardly facing edge arranged to mate with the frame portion, the rear portions having different respective external shapes for imparting different effects to golf shots; and a releasable fastening structure for selectively securing a selected rear portion to the front portion, wherein the front portion includes a rearwardly extending base having an upstanding tab at its rear end;

the rear portion including a back wall;

the releasable fastening structure including a screw connecting the back wall to the tab;

wherein the plurality of exchangeable rear portions includes at least two of: i) a rear portion of generally rectangular shape; ii) a rear portion of generally triangular shape; and iii) a rear portion of generally reverse C-shape, wherein all shapes are from a top view.

12. The kit according to claim 11 wherein the plurality of exchangeable rear portions includes all three of i) the rear portion of generally rectangular shape; ii) the rear portion of generally triangular shape; and iii) the rear portion of generally reverse C-shape.

* * * * *